United States Patent [19]

Rasmussen

[11] Patent Number: 4,869,008

[45] Date of Patent: Sep. 26, 1989

[54] REPLACEMENT GUN STOCK UNIT

[75] Inventor: Elmer M. Rasmussen, Pioneertown, Calif.

[73] Assignee: Bull-Pup Industries, Inc., Pioneertown, Calif.

[21] Appl. No.: 119,566

[22] Filed: Nov. 12, 1987

[51] Int. Cl.[4] ..... F41C 23/00

[52] U.S. Cl. ..... 42/71.01; 42/69.01

[58] Field of Search ..... 42/69.01, 71.01, 72; 89/27.3, 136

[56] References Cited

U.S. PATENT DOCUMENTS

| | | | |
|---|---|---|---|
| 3,828,458 | 8/1974 | Skone-Palmer | 42/69.01 |
| 4,601,123 | 7/1986 | Swearengen et al. | 42/72 |
| 4,663,876 | 5/1987 | Reaume | 42/72 |
| 4,677,781 | 7/1987 | Lee | 42/72 |

*Primary Examiner*—Deborah L. Kyle
*Assistant Examiner*—Richard W. Wendtland
*Attorney, Agent, or Firm*—Charles E. Brown; Charles A. Brown

[57] ABSTRACT

A substitute stock and trigger assembly for a gun of the rifle and shotgun type. The original stock is discarded and the substitute stock is mounted on the gun in lieu thereof. The substitute stock has a trigger member which is positioned a considerable distance in advance of the original trigger and immediately in front of a hand grip whereby a forefinger of the hand gripping the hand grip and supporting the gun may be utilized to actuate the trigger member. The trigger member is connected to the original trigger by a trigger assembly which includes, among other things, a pump piston and cylinder associated with the trigger member and an actuated piston and cylinder positioned adjacent the original trigger and engageable with a pivoted arm which engages the original trigger so as to effect the pushing of the original trigger to fire the gun.

14 Claims, 2 Drawing Sheets

20
22
24
26
28
32
34
36
48
50
3
4
88
90
92
94
96
98
100
102
104
106
108
110
112
114
116

REPLACEMENT GUN STOCK UNIT

This invention relates in general to new and useful improvements in stocks for guns, and more particularly to a stock for converting a gun for use by one arm.

This invention particularly relates to a stock for a gun of the shotgun or rifle type wherein the customary stock which extends the length of the gun is replaced by a special stock which provides a butt closely adjacent and behind the original trigger and a hand grip a material distance in advance of the original trigger so that one may fire the gun with accuracy by grasping the hand grip in one's hand and bringing the butt to bear against the shoulder of the same arm so that the gun may be fired by a handicapped person having the use of only one arm.

Further, in accordance with this invention, there has been provided a trigger assembly which is mounted in the substitute stock with the trigger assembly including a trigger member positioned immediately in front of the hand grip for engagement by a finger of the same hand which engages the hand grip and the trigger assembly having a mechanism coupled with the trigger member to actuate the original gun trigger.

Most particularly, in accordance with this invention, there is provided a trigger assembly which includes a pump cylinder actuated by a trigger member and a further cylinder having an actuated piston with the two cylinders being connected by a hydraulic line whereby when the pump cylinder is actuated by moving the pump piston thereof, the actuated piston is moved so as to operate the original trigger of the gun.

With the above and other objects in view that will hereinafter appear, the nature of the invention will be more clearly understood by reference to the following detailed description, the appended claims, and the several views illustrated in the accompanying drawings.

Figures 1, 2, 3, 4, 11:
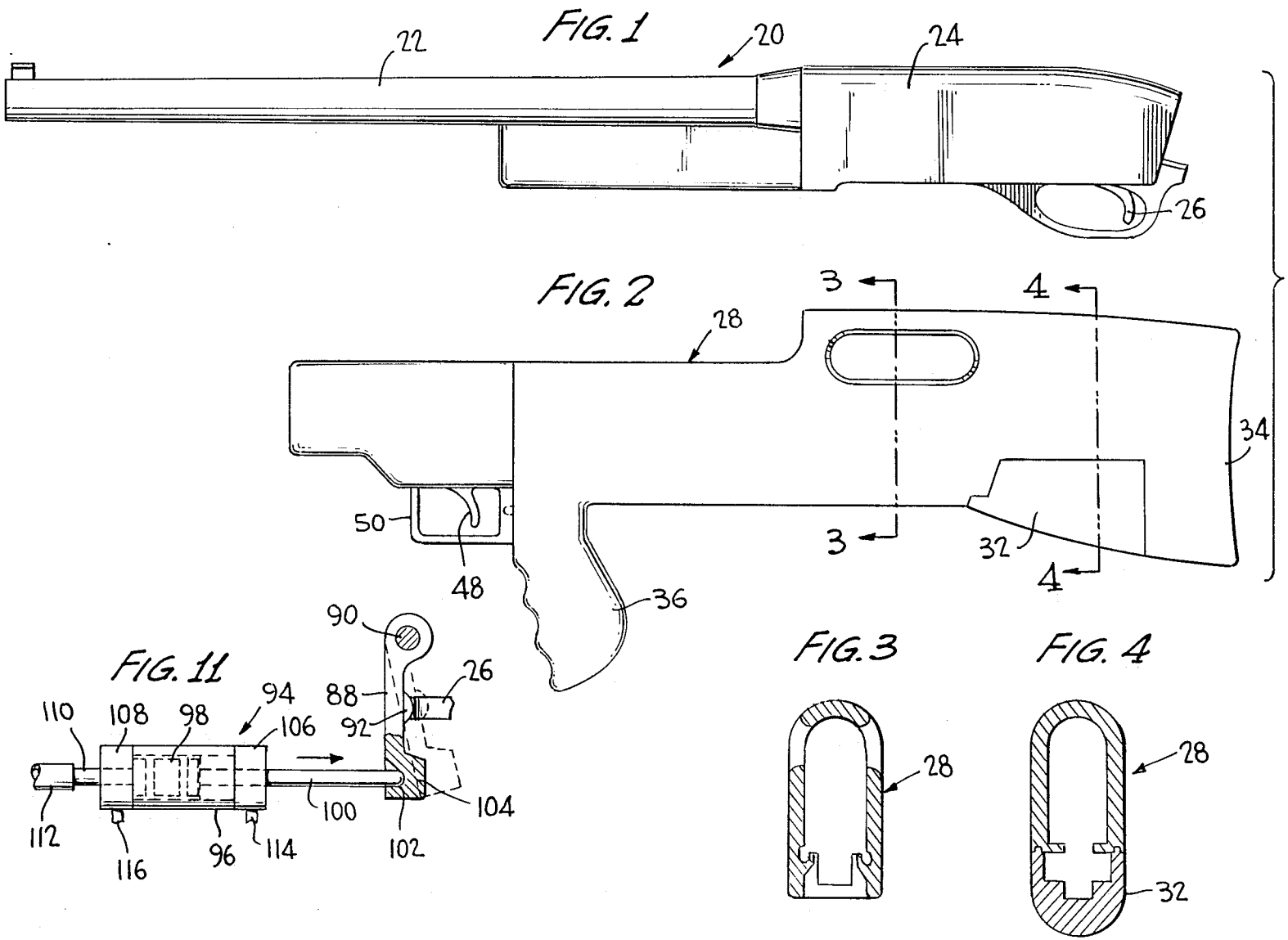
FIG. 1 is a side elevational view of a conventional gun having the original stock thereof removed.
FIG. 2 is a side elevational view of a substitute stock particularly configurated for use in conjunction with the gun of FIG. 1.
FIG. 3 is a transverse vertical sectional view taken through the substitute stock and shows the general cross section thereof for receiving the gun of FIG. 1.
FIG. 4 is a transverse vertical sectional view taken generally along the line 4—4 of FIG. 2 and shows the cross section of the stock including a cover member which encloses the original trigger of the gun.
FIG. 11 is a plan view of the actuated piston and its associated cylinder and a pivotally mounted arm engaged by the piston rod thereof for actuating the original gun trigger.

Referring now to the drawings in detail, it will be seen that there is illustrated in FIG. 1 a conventional gun which is identified by the numeral 20 and which has the original stock thereof removed so that there remains only the barrel 22, shell handling and storage mechanism 24 and the original trigger 26.

In FIG. 2 there is illustrated a substitute stock for the gun 20 as shown in FIG. 1, the substitute stock being generally identified by the numeral 28. The substitute stock is preferably of a molded plastic construction and is of a cross section as shown in FIGS. 3 and 4 for receiving in telescoped relation the rear portion of the gun 20. The mounting of the gun 20 within the rear portion of the stock 28 is clearly shown in FIG. 6. The usual fasteners which secure the gun 20 to the original stock are generally utilized and are not shown.

Figures 5, 6, 7, 8, 9, 10:
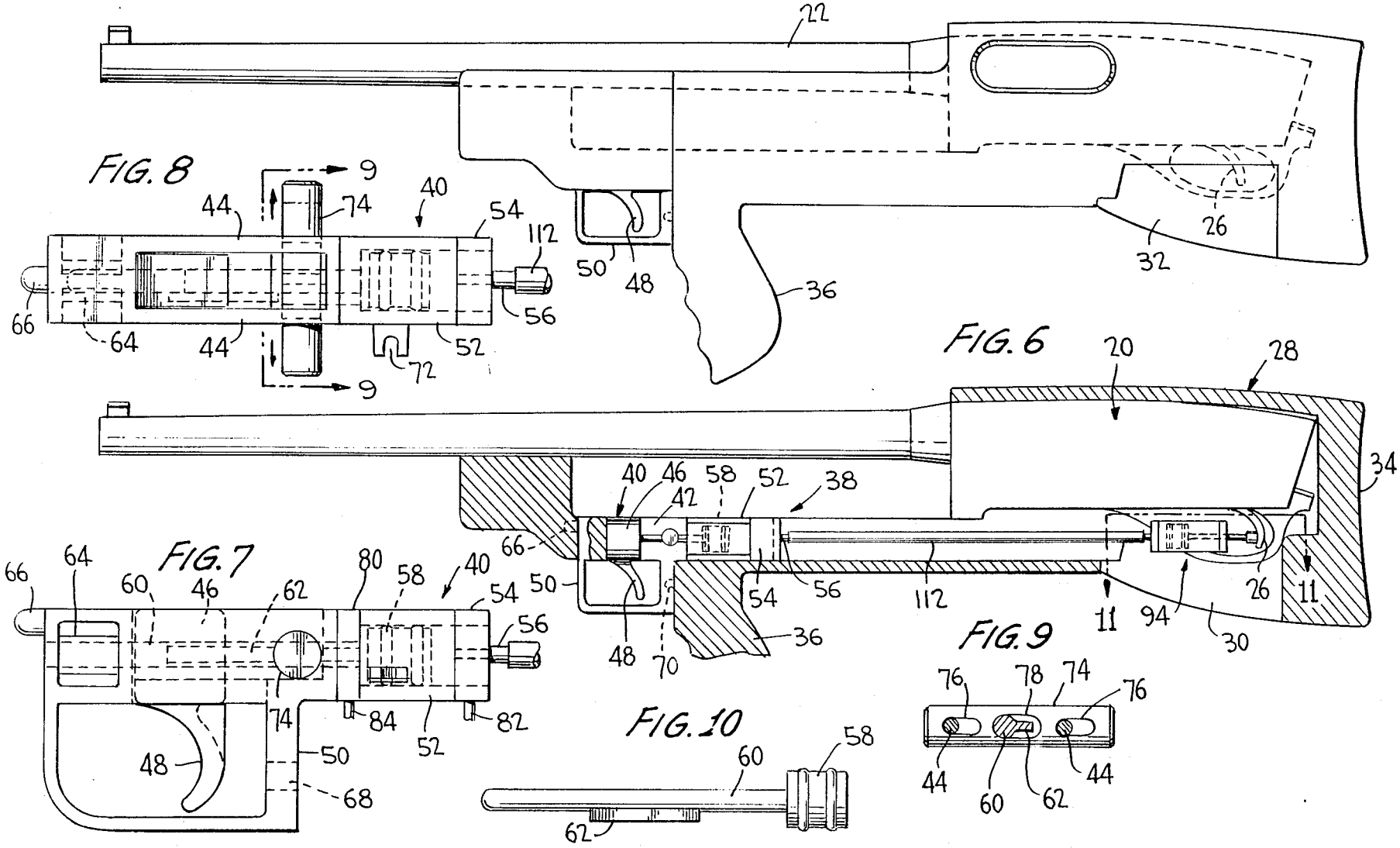
FIG. 5 is a side elevational view similar to FIGS. 1 and 2 and shows the stock of FIG. 2 assembled with the gun of FIG. 1.
FIG. 6 is a longitudinal vertical sectional view taken through the stock and showing the trigger assembly of the stock positioned for engaging the trigger of the gun.
FIG. 7 is an enlarged fragmentary side elevational view of the pump portion of the trigger assembly.
FIG. 8 is a top plan view of the pump assembly of FIG. 7.
FIG. 9 is a transverse vertical sectional view taken generally along the line 9—9 of FIG. 8 and shows the details of a safety.
FIG. 10 is a top plan view of the pump piston and piston rod thereof including an abutment member for engaging the safety.

It will be seen from FIG. 6 that the lower rear part of the stock 28 has what is defined as an original trigger receiving portion 30. The opening shown in FIG. 6 at the original trigger receiving portion 30 is normally closed by a housing 32 which is in snapped interlocked relation with the stock 28.

Closely adjacent to and rearwardly of the original trigger receiving portion 30 is the butt 34 of the stock for engaging one's shoulder. Spaced a material distance in advance of the original trigger receiving portion 30 is a depending hand grip 36 which underlies a portion of the gun barrel 22.

Suitably mounted within the stock 28 is a trigger assembly, generally identified by the numeral 38, for actuating the original gun trigger 26 from a position in advance of the hand grip 36, normally by utilizing the forefinger of the hand which grips the hand grip 36.

The trigger assembly 38 includes a guide unit 40 which is mounted within the stock 28 in the vicinity of the hand grip 36. The guide unit 40 defines a guide passage 42 which is provided with a pair of longitudinally extending guide rods 44 which are best shown in FIG. 9. A slide member 46 is mounted in the guide unit 40 on the rods 44 for longitudinal sliding movement only. A trigger member 48 is fixedly secured to the slide member 46 for movement therewith.

The guide unit 40 also is provided with a trigger guard 50 which generally surrounds the trigger 48 and is positioned immediately in front of the hand grip 36.

The guide unit 40 includes at its rear portion a pump cylinder 52 which has the rear end thereof closed by a cylinder cap 54 which, in turn, carries a discharge tube 56. A pump piston 58 is mounted within the pump cylinder 52 and is carried by a piston rod 60 which is best illustrated in FIG. 10. The piston rod 60 carries an abutment member 62 which has a dual purpose. As is shown in FIGS. 7 and 8, the forward portion of the piston rod 60 extends through the slide member and is engaged within a sleeve 64 in the forward part of the guide unit. The slide member 46 is notched to receive the abutment member 62 with the forward or retracted position of the piston rod 60 being one wherein the forward or left end of the abutment member 62 abuts against a shoulder within the slide member 46 so that when the slide member 46 is moved to the right, the piston rod 60 will automatically be moved.

At this time it is pointed out that the guide unit 40 is mounted in the stock 28 in several manners. First of all, there is a rounded pin 66 at the top forward end of the guide unit. This is received in a suitable bore in the forward portion of the stock 28. Next, there is a bore 68 through the rear vertical portion of the trigger guard 50, as is shown in FIG. 7, which will engage over a pin 70 carried by the hand grip 36. Finally, there extends from the bottom of the pump cylinder 52 a mounting bracket 72.

The previously described rods 44 of the guide unit 40 carry a transversely extending safety 74. As is best shown in FIG. 9, the safety 74 has a pair of slots 76 through which the rods 44 pass so as to permit the safety 74 to be moved to the left in the illustrated embodiment of FIG. 9.

The safety 74 is also provided with a central slot 78 which receives the piston rod 60 and, when the safety 74 is properly positioned, will also receive the abutment member 62. As is best shown in FIG. 7, the abutment member 62 is normally immediately in front of the safety 74. However, when the safety is pushed to move it to the left, as viewed in FIG. 9, the abutment member 62 will no longer be aligned with the slot 78 and thus the safety 74 will prevent the rearward movement of the piston rod 60.

Referring now to FIG. 7 in particular, it will be seen that the pump cylinder 52 is also provided with a head cap 80 at the forward end thereof through which the piston rod 60 passes in sealed relation. The head caps 54, 80 are provided with fluid passage members 82, 84 through which a suitable oil may be placed within the pump cylinder 52. These fluid passages 82, 84 will normally be closed by means of suitable plugs.

Referring now to FIGS. 6 and 11 in particular, it will be seen that there is mounted within the original trigger receiving portion 30 of the stock 28 a horizontally disposed arm 88 which extends transversely of the gun. The arm 88 is mounted for pivotal movement on a vertically extending pivot pin 90 and the arm 88 is positioned immediately in front of the original trigger 26. Further, the arm 88 has carried by the central portion thereof a button 92 which is aligned with the original trigger 26 as is clearly shown in FIG. 11.

An actuator unit is utilized to pivot the arm 88 from its solid line position of FIG. 11 to its dotted line trigger actuated position. The actuator unit is generally identified by the numeral 94 and includes a fluid cylinder 96 having therein an actuated piston 98. The piston 98, in turn, carries a piston rod 100 which is engaged in a notch 102 of an enlargement 104 of the arm 88 at a free end of the arm. The cylinder 90 is suitably anchored within the stock 28 so as not to be shiftable.

The cylinder 96 is provided with head caps 106, 108, with the head cap 106 having the piston rod 100 passing therethrough in sealed relation. The head cap 108, on the other hand, is provided with a length of tubing 110 which corresponds to the length of tubing 56 carried by the head cap 54. A length of plastic tubing 112 extends between the tubing 56 and 110 and connects the head end of the cylinder 52 with the head end of the cylinder 96 so that when the pump piston 58 is moved rearwardly and pumps fluid through the tubing 112, the fluid will enter into the cylinder 96 and move the actuated piston 98 to the rear thereby pivoting the arm 88 and actuating the original trigger 26 of the gun 20.

The head caps 106, 108 are also provided with lengths of tubing 114, 116 through which the cylinder 98 may be filled. It is also to be understood that when the cylinders 52, 96 are filled, the tubing 112 is also filled. Suitable plugs (not shown) will close the tubing 114, 116.

At this time it is pointed out that the cover 32 protects the actuator unit 94 and the original trigger 26 as will be apparent from FIG. 5.

Inasmuch as the trigger assembly is to be operated under both hot temperature adverse conditions and cold temperature adverse conditions, a special silicone oil is utilized as the force transmitting fluid between the trigger member 48 and the original trigger 26.

It should be readily apparent that when the gun 20 is fitted with the substitute stock 28, the gun 20 will function in the normal manner. However, the trigger 26 will be actuated by remote control utilizing the trigger assembly 38.

The gun is gripped in one's hand by the hand grip 36 and the butt 34 is brought into engagement with one's shoulder. The hand grip 36 will be so distanced from the butt 34 that one's arm will be generally outstretched while pulling the butt against one's shoulder. The gun is then so positioned wherein the usual gun sights may be utilized for aiming the gun after which the gun may be fired by pulling on the trigger member 48. It has been found that the movement of the trigger member 48 is easier than pulling the original trigger 26.

It is to be understood that the internal configuration of the substitute stock 28 will be varied in accordance with the particular rifle or shotgun to which it is to be fitted.

Although only a preferred embodiment of substitute gun stock and trigger assembly has been specifically illustrated and described herein, it is to be understood that minor variations may be made in the gun stock and trigger assembly without departing from the spirit and scope of the invention as defined by the appended claims.

What is claimed is:

1. A replacement stock unit for converting a conventional gun of the rifle and shotgun type to a one-handed gun, said stock unit comprising a stock of a size and shape to receive a gun including an original trigger mechanism, said stock having an original trigger receiving portion, said stock having a butt closely adjacent and rearward of said original trigger receiving portion, said stock including a depending hand grip spaced a distance in advance of said original trigger receiving portion, and a trigger assembly removably mounted in said stock, said trigger assembly including an actuator including a trigger member positioned in front of said hand grip, a trigger actuator positioned at said original trigger receiving portion for actuating an original trigger, and means coupling said trigger member to said trigger actuator, said trigger assembly including a guide unit carried by said stock within said stock, and a slide member slidably carried by said guide unit for longitudinal movement only, and said trigger member being fixedly carried by said slide member, said guide unit including a pump cylinder having a pump piston and a pump piston rod, said pump piston rod being engaged by said slide member for actuation by said trigger member.

2. A stock unit according to claim 1 wherein said guide unit carries transversely extending and movable safety member having passing therethrough said piston rod, and a transversely extending projection on said piston rod for selectively passing through said safety member and abutting said safety member.

3. A replacement stock unit for converting a conventional gun of the rifle and shotgun type to a one-handed gun, said stock unit comprising a stock of a size and shape to receive a gun including an original trigger mechanism, said stock having an orignal trigger receiving portion, said stock having a butt closely adjacent and rearward of said original trigger receiving portion, said stock including a depending hand grip spaced a distance in advance of said original trigger receiving portion, and a trigger assembly removably mounted in said stock, said trigger assembly including an actuator including a trigger member positioned in front of said hand grip, a trigger actuator positioned at said original trigger receiving portion for actuating an original trigger, and means coupling said trigger member to said trigger actuator, said trigger actuator including an arm extending transversely of said stock and being pivotally mounted on said stock for longitudinal swinging movement to actuate an original trigger, and an actuated device being connected to said arm for pivoting said arm in response to longitudinal movement of said trigger member.

4. A replacement stock unit for converting a conventional gun of the rifle and shotgun type to a one-handed gun, said stock unit comprising a stock of a size and shape to receive a gun including an original trigger mechanism, said stock having an original trigger receiving portion, said stock having a butt closely adjacent and rearward of said original trigger receiving portion, said stock including a depending hand grip spaced a distance in advance of said original trigger receiving portion, and a trigger assembly removably mounted in said stock, said trigger assembly including an actuator including a trigger member positioned in front of said hand grip, a trigger actuator positioned at said original trigger receiving portion for actuating an original trigger, and means coupling said trigger member to said trigger actuator, said trigger assembly including a guide unit carried by said stock within said stock, and a slide member slidably carried by said guide unit for longitudinal movement only, and said trigger member being fixedly carried by said slide member, said trigger actuator including an arm extending transversely of said stock and being pivotally mounted on said stock for longitudinal swinging movement to actuate an original trigger, and an actuated device being connected to said arm for pivoting said arm in response to longitudinal movement of said trigger member.

5. A stock unit according to claim 4 wherein said actuated device includes a cylinder having an actuated piston and a piston rod, and said piston rod being connected to said arm for effecting pivoting of said arm.

6. A stock unit according to claim 5 wherein said guide unit includes a pump cylinder having a pump piston and a pump piston rod, said pump piston rod being engaged by said slide member for actuation by said trigger member, and a fluid line connecting said pump cylinder to said cylinder of said actuated device for operation of said actuated piston by said pump piston.

7. A stock unit according to claim 6 wherein a silicone oil readily flowable at high and low temperatures fills said fluid lines and adjacent portions of said cylinders.

8. A trigger assembly for actuating a gun trigger from a remote position, said trigger assembly comprising an actuator including a trigger member, a trigger actuator being positioned remote from said actuator, and means coupling said trigger member to said trigger actuator, said trigger assembly including a guide unit, and a slide member being slidably carried by said guide unit for movement along the length of said guide unit, and said trigger member being fixedly carried by said slide member, said guide unit including a pump cylinder having a pump piston and a pump piston rod, said pump piston rod being engaged by said slide member for actuation by said trigger member.

9. A trigger assembly according to claim 8 wherein said guide unit carries a transversely extending and movable safety member having passing therethrough said piston rod, and a transversely extending projection on said piston rod for selectively passing through said safety member and abutting said safety member.

10. A trigger assembly for actuating a gun trigger from a remote position, said trigger assembly comprising an actuator including a trigger member, a trigger actuator being positioned remote from said actuator, and means coupling said trigger member to said trigger actuator, said trigger actuator including an arm having pivotal mounting means to mount said arm in a transversely extending trigger engaging position for longitudinal swinging movement to actuate a trigger, and an actuated device being connected to said arm for pivoting said arm in response to movement of said trigger member along the length of said guide unit.

11. A trigger assembly for actuating a gun trigger from a remote position, said trigger assembly comprising an actuator including a trigger member, a trigger actuator being positioned remote from said actuator, and means coupling said trigger member to said trigger actuator, said trigger assembly including a guide unit, and slide member being slidable carried by said guide unit for movement along the length of said guide unit, and said trigger member being fixedly carried by said slide member, said trigger actuator including an arm having pivotal mounting means to mount said arm in a transversely extending trigger engaging position for longitudinal swinging movement to actuate a trigger, and an actuated device being connected to said arm for pivoting said arm in response to the movement of said trigger member.

12. A trigger assembly according to claim 11 wherein said actuated device includes a cylinder having an actuated piston and a piston rod, and said piston rod being connected to said arm for effecting pivoting of said arm.

13. A trigger assembly according to claim 12 wherein said guide unit includes a pump cylinder having a pump piston and a pump piston rod, said pump piston rod being engaged by said slide member for actuation by said trigger member.

14. A trigger assembly according to claim 14 wherein a silicone oil readily flowable at high and low temperatures fills said fluid lines and adjacent portions of said cylinders.

* * * * *